United States Patent [19]

Wildman et al.

[11] Patent Number: 4,642,912

[45] Date of Patent: Feb. 17, 1987

[54] SHOE INSOLE

[75] Inventors: Gary C. Wildman, Germantown; Frank Wirth; Vijay Surpuriya, both of Memphis, all of Tenn.

[73] Assignee: Scholl, Inc., Memphis, Tenn.

[21] Appl. No.: 606,027

[22] Filed: May 2, 1984

[51] Int. Cl.[4] ..... A43B 13/40

[52] U.S. Cl. ..... 36/44; 128/595; 428/316.6

[58] Field of Search ..... 36/44, 43, 71, 3 B; 128/595; 428/316.6

[56] References Cited

U.S. PATENT DOCUMENTS 4,054,706 10/1977 Shapiro ..... 36/44 X
4,130,948 12/1978 Krug ..... 36/44
4,185,402 1/1980 Digate ..... 36/44
4,187,621 2/1980 Cohen ..... 36/44
4,413,429 11/1983 Power ..... 36/44

*Primary Examiner*—James Kee Chi

*Attorney, Agent, or Firm*—Gerald S. Rosen; Warrick E. Lee, Jr.

[57] ABSTRACT

A shoe insole having superior cushioning and comfort, good resistance to buckling, and excellent retention of cushioning properties after wear. The insole consists of three layers:

(a) a bottom layer having compressive strength of at least 0.3 kg/cm$^2$ at 40% strain, (b) an intermediate layer having less compressive strength at 40% strain than the bottom layer, and (c) a top layer constructed of fabric. The three layers are laminated together and shaped to fit inside of an article of footwear.

5 Claims, 2 Drawing Figures

SHOE INSOLE

The present invention relates to a shoe insole that may be inserted into an article of footwear. The inventive insole provides superior cushioning and comfort and has good resistance to buckling and excellent retention of its cushioning properties after wear. The inventive insole is suprisingly simple to manufacture.

Hsuing (U.S. Pat. No. 4,055,699) discloses a four-layer insole that is intended primarily to provide insulation to the bottom of the foot. Hsuing's insole is more difficult to make than that of the present invention.

Scholl (U.S. Pat. No. 3,253,601, discloses a single layer insole. While relatively simple to make, Scholl's insole lacks the comfort and cushioning of the present invention.

SUMMARY OF THE INVENTION

The present invention comprises an insole for disposition in a article of footwear consisting of:

(a) a bottom layer constructed of flexible foam having a compressive strength of at least 0.3 kg/cm$^2$ at 40 percent strain, (b) an intermediate layer constructed of flexible foam having a compressive strength at 40 percent strain, less than that of said bottom layer, and (c) a top layer constructed of fabric, said layers laminated together and shaped to fit inside of an article of footwear.

DETAILED DESCRIPTION OF THE INVENTION

Figure 1:
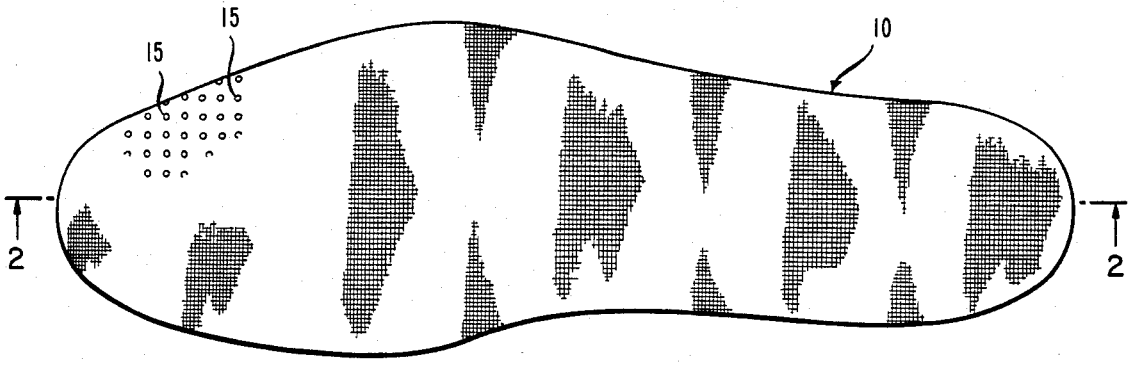
FIG. 1 is a top view of an insole in accordance with the invention.
Figure 2:
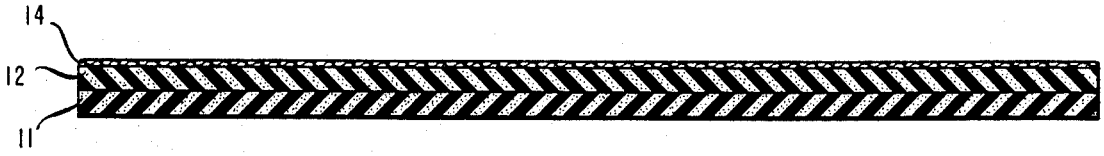
FIG. 2 is a sectional view of the insole of FIG. 1 taken along section 2—2.

As illustrated in FIG. 1, the insole 10 of the invention may have the general outline of a human foot. The insole has three layers that are laminated together.

Bottom layer 11 is constructed of flexible foam having a compressive strength of at least 0.3 kg/cm$^2$ at 40 percent strain. That is, a compressive force of at least 0.3 kg/cm$^2$ is required to reduce the thickness of the layer by 40 percent of its unstressed thickness. Preferably layer 11 has compressive strength at 40 percent strain between 0.3 and 1.3 kg/cm$^2$, more preferably 0.6 to 1.2 kg/cm$^2$. Layer 11 is preferably from 1.2 to 1.8 mm thick. Preferably layer 11 has less than 50 percent (more preferably less than 20 percent) compression set.

Compression set is determined as followed. The initial thickness of the foam is measured without any stress applied. Then a compressive force sufficient to reduce the thickness of the foam by 50 percent is applied. With this force applied, the material is maintained in an oven at 70° C. for about 23 hours. The material is removed from the oven and the force is released. The thickness of the unstressed material is then measured and subtracted from the initial thickness. This gives the loss in thickness, or set. The compression set is 100 multiplied by the ratio of the loss in thickness to the initial thickness.

Intermedite layer 12 is constructed of flexible foam having a compressive strength less than that of the bottom layer at 40 percent strain. Preferably intermediate layer 12 has compressive strength at 40 percent strain in the range of 0.2 to 1.1 kg/cm$^2$, more preferably 0.2 to 0.7 kg/cm$^2$. Layer 12 is preferably from 1.2 to 1.8 mm thick. Layer 12 preferably has compressive set less than 50 percent (more preferably less than 20 percent).

Layers 11 and 12 may be made of flexible foamed materials such as rubber latex, urethane, polyvinyl chloride, styrene-butadiene latex, polyolefin, or any other flexible foamed material having the required compressive strengths. The preferred material is sulfur-vulcanized, styrene-butadiene latex, open-celled foam containing 2 to 80 weight percent filler and pigment, more preferably 40 to 60 percent. The foam may also contain fragrance and odor controlling ingredients.

Top layer 14 is fabric such as a twill weave of cotton and acetate. Other woven and non woven fabrics such as cotton, polyester, nylon and various fiber blends may be used. Top layer 14 may have thickness of 0.2 to 0.4 mm.

Layers 11, 12, and 14 are laminated together and shaped to fit inside of an article of footwear, such as a shoe or boot. The preferred shape for an insole for the right foot is shown in FIG. 1. An insole for the left foot would be a mirror image of the insole of FIG. 1.

The insole may have perforations 15, i.e. small vertical holes. These holes are about 1 mm in diameter spaced about 6 mm apart. The holes preferable pass through all three layers. It is preferable to perforate the entire insole. For simplicity only a small portion of the insole is shown perforated in FIG. 1. Manufacture of the invention insoles may be performed by foaming and laminating techniques known in the art, see example, U.S. Pat. Nos. 4,257,176 and 4,185,402, incorporated herein by reference. The desired compressive properties may be attained by varying various manufacturing properties such as density, amount of filler etc.

EXAMPLE OF THE PRESENT INVENTION

An insole is accordance with FIG. 1 is constructed as follows:

| | |
|---|---|
| Bottom Layer 11 | |
| Thickness: | 1.5 mm |
| Density: | 15 lb/ft$^3$ |
| Compressive strength at 40% strain: | 0.8 kg/cm$^2$ |
| Material: | sulfur-vulcanized, styrene-butadiene, open-cell foam |
| Compression set: | Less than 10 percent |
| Intermediate Layer 12 | |
| Thickness: | 1.5 mm |
| Density: | 12 lb/ft$^3$ |
| Compressive strength at 40% strain: | 0.5 kg/cm$^2$ |
| Material: | sulfur-vulcanized, styrene-butadiene, open-cell foam |
| Compression set: | Less than 10 percent |
| Top Layer 14 | |
| Thickness: | 0.3 mm |
| Material: | cotton-acetate cloth |

COMPARATIVE PRIOR-ART EXAMPLE

A two-layer insole that has been sold in the United States for a number of years has the following properties.

| | |
|---|---|
| Bottom Layer | |
| Thickness: | 3 mm |
| Density: | 12 lb/ft$^3$ |
| Compressive strength at 40% strain: | 0.5 kg/cm$^2$ |
| Material: | styrene-butadiene, open-cell foam |
| Compression set: | Less than 10 percent |
| Top Layer | |
| Thickness: | 0.3 mm |
| Material: | cotton-acetate cloth |

The cushioning capacities of the two insoles were compared by measuring the thickness of the insole as it was loaded with increasing weight from 0 to 2.5 kg/cm$^2$, the approximate force of a man standing on one heel. A plot of the applied force versus thickness was drawn for each insole. The area under the curve is a measure of the cushioning capacity. The three-layer insole of the invention provided 15 percent better cushioning than the prior art two-layer insole. Upon wear the insoles of the above examples lose some cushioning properties; but the insole of the invention retains cushioning better than that of prior art. At the end of a 15 day wear test the insole of the invention provided 42 percent more cushioning than the prior art two-layer insole. Furthermore, the insole of the present invention feels soft and comfortable against the foot, despite its greater cushioning ability.

What is claimed is:

1. An insole for disposition in an article of footwear to provide cushioning and comfort to the user consisting of:

(a) a bottom layer constructed of flexible foam having a compressive strength of at least 0.3 kg/cm$^2$ at 40 percent strain, a compressive set of less than 20% and a substantially uniform thickness, (b) an intermediate layer constructed of flexible foam having a compressive strength at 40 percent strain less than that of said bottom layer, a compressive set of less than 20% and a substantially uniform thickness, and (c) a top layer constructed of fabric, said layers laminated together and shaped to fit inside of an article of footwear to provide cushioning and comfort to the user without substantial permanent deformation of any of said layers to the users foot.

2. The insole of claim 1 wherein said bottom layer has compressive strength between 0.6 and 1.2 kg/cm$^2$ and said intermediate layer has compressive strength between 0.2 and 0.7 kg/cm$^2$.

3. The insole of claim 1 wherein the bottom layer is from 1.2 to 1.8 mm thick, the intermediate layer is from 1.2 to 1.8 mm thick and the top layer is 0.2 to 0.4 mm thick.

4. The insole of claim 3 wherein the bottom layer is 1.5 mm thick, has a compressive strength at 40% strain of 0.8 kg/cm$^2$ and a compression set of less than 10%; the intermediate layer is 1.5 mm thick, has a compressive strength at 40% strain of 0.5 kg/cm$^2$ and a compression set of less than 10%; and the top layer is 0.3 mm thick.

5. The insole of claim 4 wherein the bottom and intermediate layers are each made of sulfur-vulcanized styrene-butadiene open cell foam and the top layer is made of cotton-acetate cloth.

* * * * *